US011465198B2

(12) United States Patent
Gravier et al.

(10) Patent No.: US 11,465,198 B2
(45) Date of Patent: Oct. 11, 2022

(54) INJECTION DEVICE AND METHOD FOR PRODUCING AT LEAST ONE METALLIC GLASS PART

(71) Applicants: UNIVERSITE GRENOBLE ALPES, Saint Martin d'Heres (FR); INSTITUT POLYTECHNIQUE DE GRENOBLE, Grenoble (FR)

(72) Inventors: Sébastien Gravier, Saint Martin d'Heres (FR); Georges Kapelski, Vaulnaveys le Haut (FR)

(73) Assignees: UNIVERSITE GRENOBLE ALPES, Saint Martin d'Heres (FR); INSTITUT POLYTECHNIQUE DE GRENOBLE, Grenoble (FR)

( * ) Notice: Subject to any disclaimer, the term of this patent is extended or adjusted under 35 U.S.C. 154(b) by 129 days.

(21) Appl. No.: 16/620,418

(22) PCT Filed: Jun. 4, 2018

(86) PCT No.: PCT/EP2018/064562
§ 371 (c)(1),
(2) Date: Mar. 24, 2020

(87) PCT Pub. No.: WO2018/224418
PCT Pub. Date: Dec. 13, 2018

(65) Prior Publication Data

US 2020/0222976 A1 Jul. 16, 2020

(30) Foreign Application Priority Data

Jun. 9, 2017 (FR) ..... 1755186

(51) Int. Cl.

| | |
|---|---|
| ***B22D 17/04*** | (2006.01) |
| ***B22D 17/20*** | (2006.01) |
| ***B22D 17/30*** | (2006.01) |
| ***B22D 25/06*** | (2006.01) |

(52) U.S. Cl.
CPC ..... *B22D 17/04* (2013.01); *B22D 17/203* (2013.01); *B22D 17/30* (2013.01); *B22D 25/06* (2013.01)

(58) Field of Classification Search
CPC ..... B22D 17/04; B22D 17/203; B22D 17/30; B22D 25/06; B22D 17/2023; B22D 17/2038
See application file for complete search history.

(56) References Cited

U.S. PATENT DOCUMENTS

| | | | | |
|---|---|---|---|---|
| 4,006,774 A * | 2/1977 | Mikulski | ..... | B22D 17/08 164/312 |
| 4,347,889 A * | 9/1982 | Komatsu | ..... | B22D 17/30 164/113 |
| 5,954,116 A | 9/1999 | Jung | | |
| 8,356,655 B2 * | 1/2013 | Bochiechio | ..... | B22D 17/2015 164/312 |

FOREIGN PATENT DOCUMENTS

| | | | |
|---|---|---|---|
| EP | 0875318 | A1 | 11/1998 |
| JP | 2004114058 | A | 4/2004 |
| JP | 3784578 | B2 | 6/2006 |
| JP | 2012110934 | A | 6/2012 |
| WO | 2013158069 | A1 | 10/2013 |

OTHER PUBLICATIONS

English machine translation of Sato et al. (Year: 2004).*
International Search Report from corresponding International Application No. PCT/EP2018/064562, dated Jul. 20, 2018, pp. 1-6, European Patent Office, Rijswijk, The Netherlands.
Written Opinion from corresponding International Application No. PCT/EP2018/064562, pp. 1-8, European Patent Office, Rijswijk, The Netherlands.

* cited by examiner

*Primary Examiner* — Kevin P Kerns
*Assistant Examiner* — Steven S Ha
(74) *Attorney, Agent, or Firm* — Hauptman Ham, LLP

(57) ABSTRACT

An injection device and method for producing at least one metallic glass part, in which a vertical piston is able to move in a vertical direction, a top end portion of the piston being suitable for being engaged in an injection chamber of a mould linked to a cavity of this mould and open at the bottom; the piston having a top end face on which an element made from metallic glass to be introduced into said chamber can be positioned, the top face of the piston having a concave shape suitable for receiving a bottom portion of the element made from metallic glass. A heating means situated under the mould comprises induction coils, such that, when the piston is in an intermediate position, the majority of the metallic element is situated in the space surrounded by the induction coils.

20 Claims, 12 Drawing Sheets

INJECTION DEVICE AND METHOD FOR PRODUCING AT LEAST ONE METALLIC GLASS PART

DOMAIN OF THE INVENTION

The present invention relates to the field of producing, by injection, metallic glass parts, also known as amorphous metals or amorphous metal alloys.

Metallic glasses are recent materials which are conventionally obtained by rapid cooling of a molten metal or metal alloy.

The term "metallic glasses" applies to metals or metal alloys that are not crystalline and further applies to metals or metal alloys that are partially crystalline and which thus contain a crystal fraction. In general, the fraction of the amorphous phase is greater than 50%.

The amorphous structure of metallic glasses gives them particularly interesting properties: a very high mechanical strength, a high elastic strain capacity, which is generally greater than 1.5%, and high resistance to corrosion and abrasion.

The production of metallic glasses in particular having a zirconium (Zr), magnesium (Mg), iron (Fe), copper (Cu), aluminium (Al), palladium (Pd), platinum (Pt), titanium (Ti) or cobalt (Co) base is already known.

Using a material suitable for forming a metallic glass, parts made of a metallic glass are produced in the shapes desired for specific uses.

TECHNOLOGICAL BACKGROUND

The patent EP 0 875 318 describes a metallic glass injection device, housed inside a chamber in a controlled atmosphere, which on the one hand comprises a melting vessel comprising a vertical cylindrical wall, the bottom whereof is formed by a radial top end face of a vertical piston and on the other hand comprises a mould which delimits a cavity and a vertical injection channel open at the bottom and in which an inner annular shoulder is fitted. At a distance beneath the mould, the melting vessel is filled with a molten metallic material under the effect of an induction coil placed around the vertical cylindrical wall of the melting vessel. The melting vessel is then moved upwards until the top edge of the cylindrical wall thereof abuts against the inner annular shoulder of the mould. The piston is then moved upwards to inject the molten metallic material into the cavity of the mould.

The patent US 2007/0215306A1 describes an injection device in which a metallic material is placed on a radial top face of a slide disposed inside a vertical cylindrical wall, forming a melting vessel, and supported by a vertical cylinder. After closing a mould and melting the metallic material under the effect of an induction coil placed around the vertical cylindrical wall, the vertical cylinder moves the slide upwards in the vertical cylindrical wall in order to inject the molten metallic material into cavities in the mould made laterally at the top end of the vertical cylindrical wall.

The patent JP 3 784 528 describes an injection device comprising a vertical injection piston provided, in the top part thereof, with a cylindrical recess of great depth receiving the entirety of a metallic element to be injected, so much so that the metallic element to be injected is in contact not only with the bottom of the recess but also with the cylindrical wall of the recess. Moreover, the injection device comprises an induction coil for heating the metallic element to be injected, such that the metallic element to be injected and the induction coil are separated by the wall of the cylindrical recess. The known injection devices described hereinabove have the drawback of not guaranteeing complete and continuous melting until injection of the metallic material into the cavity of the mould since cold points can remain or appear upon contact of the metallic material with the cold wall of the melting vessel. Such cold points can lead to the formation of crystal nuclei which are detrimental to the preservation of the amorphous structure of the molten metallic material and to the final properties of the part produced in the cavity of the mould.

SUMMARY

A present invention in particular aims to overcome such drawbacks.

According to one embodiment, an injection device is proposed for producing at least one metallic glass part, which comprises:

a mould having at least one cavity and an injection chamber linked to the cavity and open at the bottom, and a vertical injection piston coaxial to said injection chamber and extending beneath the mould.

The piston has a top end face on which a metallic element can be positioned made of a material that is capable of forming a metallic glass, such that when the piston is moved upwards, this material is inserted into the injection chamber and injected into said cavity under the effect of the piston.

The top end face of the piston has a concave shape capable of receiving a smaller bottom portion of said metallic element so as to be the sole support for this element placed thereon, such that the majority of said metallic element is situated above the end face of the piston, outside of the concave shape.

The injection device further comprises a heating means, equivalently described as heating element, which is situated beneath the mould and which comprises induction coils coaxial to the piston, such that, when the piston is in an intermediate position, the majority of the metallic element is situated in the space surrounded by the induction coils.

Thus, the metallic element is supported by the piston and a smaller bottom portion of the metallic element is exclusively in contact with the piston, such that any possible appearance of crystal nuclei, detrimental to the structural quality of the final part, would be confined to a limited volume at the bottom portion of the heated metallic element which, alone, is adjacent to the piston, and the risk of bonding of the metallic element to the piston is reduced.

The piston can have, at the top end thereof, a peripheral chamfer, which can be frustoconical.

Said concave shape can be spherical, conical or frustoconical.

The injection chamber can have an inner chamfer made in the bottom inlet thereof.

A top portion of the piston can be able to slide vertically within the injection chamber of the mould by forming a slide fit with little play.

The device can further comprise a sleeve disposed around a top end portion of the piston and capable of sliding vertically relative to the piston, the piston and the sleeve having axial abutment means, equivalently described as axial abutment element, limiting the upwards movement of the sleeve relative to the piston and a spring stressing the sleeve in the upwards direction relative to the piston, said sleeve having an annular bearing face capable of coming into contact with an annular bearing face of the mould situated at the periphery of said injection chamber.

Said sleeve can be capable of sliding vertically relative to said top end portion of the piston by forming a slide fit with little play.

Said sleeve can have an annular top face situated approximately at the top end face of the piston when said abutment means are in abutment.

Said annular bearing face of the sleeve and said annular bearing face of the mould can extend radially.

Said annular bearing face of the sleeve and said annular bearing face of the mould can be frustoconical.

A portion of the sleeve can be capable of penetrating an antechamber of the mould situated beneath the injection chamber.

The device can further comprise a heating means, equivalently described as heating element, capable of melting the element made from metallic glass placed on the top end face of the piston, before the insertion thereof into the injection chamber.

The device can comprise a means for heating, equivalently described as heating element, at least one top part of said vertical piston.

An injection method is also proposed for producing at least one metallic glass part, comprising the following steps of:

placing a metallic element made of a material capable of forming a metallic glass, in the solid state, on a top end face of a vertical injection piston, this top end face having a concave shape receiving a smaller bottom portion of said metallic element placed thereon so as to be the sole support therefor, such that the majority of said metallic element is situated above the end face of the piston, outside of the concave shape, heating said metallic element by way of a heating means situated beneath the mould and comprising induction coils coaxial to the piston (8), such that, when the piston is in an intermediate position, the majority of the metallic element is situated in the space surrounded by the induction coils, said molten metallic element being held on the top end face of the piston under the effect of said concave shape, and displacing the piston vertically upwards to insert said molten metallic element into an injection chamber of a mould, then creating a pressure inside the injection chamber of the mould in order to inject the molten metallic material into at least one cavity of the mould linked to the injection chamber.

In order to inject the molten metallic material, a top portion of the piston can be inserted into the injection chamber, the top portion of the piston and the injection chamber jointly forming a slide fit with little play for sliding.

A sleeve can be mounted on the top end portion of the piston, the sleeve and the top portion of the piston forming therebetween a slide fit with little play for sliding and the sleeve and the mould capable of having annular bearing faces bearing against one another when the metallic material is injected.

In the final injection position, a peripheral end chamfer of the piston can be facing and remote from the inside edge of the interface between said annular bearing faces bearing against one another.

At least the top part of said vertical piston can be heated.

BRIEF INTRODUCTION OF THE DRAWINGS

An injection device and the operating mode thereof will now be described by way of non-limiting examples, illustrated by the drawing in which.

DETAILED DESCRIPTION

Figure 1:
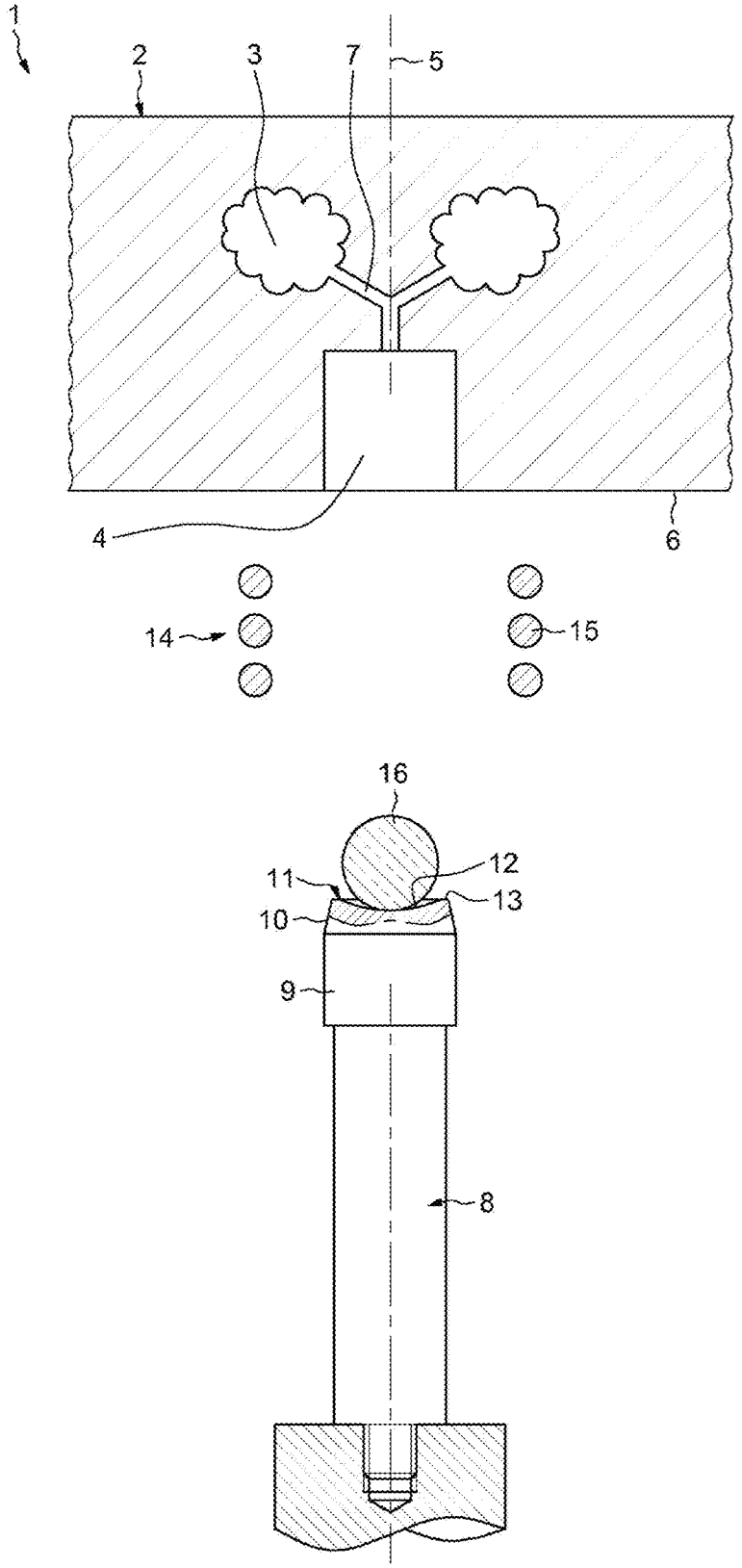
FIG. 1 shows a vertical section of an injection device in a lowered loading position.

An injection device 1 shown in FIGS. 1 to 4 comprises a mould 2 in which an inner cavity 3 is made, the shape whereof corresponds to that of a part to be produced, a cylindrical injection chamber 4, having a vertical axis 5, which opens out at the bottom on a horizontal bottom outside face 6 side of the mould 2 and an internal channel 7 which links the top part of the injection chamber 4 and the cavity 3, at the top or laterally. The cylindrical injection chamber 4 has a cylindrical peripheral wall and a bottom that is, for example, radial.

The mould 2 can have a plurality of cavities 3 linked to the injection chamber 4 by internal channels.

The injection device 1 comprises a vertical injection piston 8 that is, for example, metallic, which is disposed coaxially to the injection chamber 3, in a vertical direction 5, and which is capable of moving vertically under the effect of translational drive means (not shown) such as a cylinder or a screw-and-nut system or a ball screw system.

A cylindrical top end portion 9 of the vertical piston 8 is capable of being engaged and of sliding vertically within the cylindrical injection chamber 4 by forming a slide fit with little play. Optionally, in order to facilitate this engagement and correct potential misalignments, the vertical piston 8 has, at the top end of the cylindrical top end portion 9, a peripheral outer chamfer 10 and, potentially, the piston is long enough to provide sufficient flexibility allowing the portion 9 to slide in the chamber 4 despite misalignments. According to one alternative embodiment, the injection chamber 4 could alternatively or additionally have an annular inner chamfer made in the bottom inlet thereof.

The cylindrical top end portion 9 of the vertical piston 8 has a top end face 11 which has a central concave shape 12 and a radial annular area 13 between the concave shape 12 and the annular top end of the chamfer 10. For example, the concave shape 12 can take on the form of a spherical dish, as shown, or the form of a cone or the form of a bowl having a radial bottom and frustoconical peripheral wall.

The injection device 1 comprises a heating means 14 situated beneath the mould 2, formed, for example, by induction coils 15 coaxial to the vertical piston 8, wound, for example, into a cylinder or frustum.

According to one mode of operation, the injection operations can be carried out as follows.

As shown in FIG. 1, the piston 8 occupies a lowered loading position in which the top end face 11 thereof is situated beneath and remotely from the induction coils 15 of the heating means 14.

In this loading position, a metallic element 16 made of a material that is capable of forming a metallic glass, in solid state, taking on the shape of a grain, is deposited on the top end face 11 of the piston 8, in a situation such that the concave shape 12 receives a smaller bottom portion of the metallic element 16 and is the sole support for the metallic element 16 placed thereon, supporting same and preventing same from falling laterally towards the piston 8. The majority of the metallic element 16 is situated above the end face 11 of the piston 8, outside of the concave shape 12.

According to one alternative embodiment, the deposition operation can be carried out by a manipulator arm.

According to another alternative embodiment, the deposition operation can be carried out as follows. A containment ring is brought above and at a short distance from the top face 11 of the piston 8, the bottom end of an inclined trough is brought above the space created by the containment ring. A metallic element 16 is deposited in a top part of the trough. The element 16 slides under gravity in the trough and enters the space created by the containment ring, which prevents same from falling, the metallic element 16 being placed above the concave shape 12. Subsequently, the trough is removed and the containment ring is withdrawn without impacting the deposited metallic element 16.

For information, the volume of the metallic element 16 can be equal to about one tenth of a milliliter to three milliliters.

Figure 2:
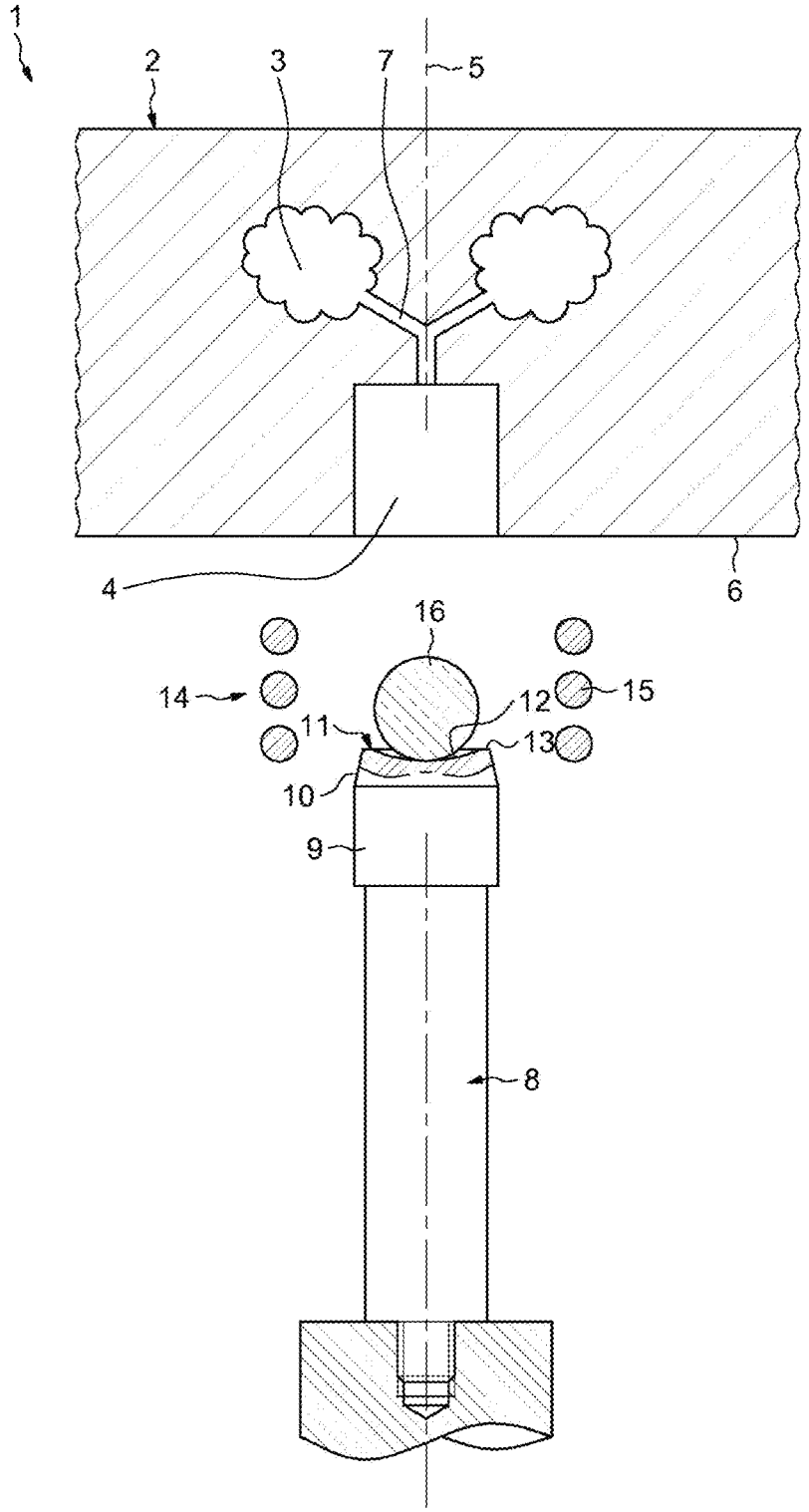
FIG. 2 shows a vertical section of the injection device in an intermediate heating position.

Subsequently, the piston 8 is moved upwards in translation to an intermediate position shown in FIG. 2, wherein the majority of the metallic element 16 is situated in the space surrounded by the induction coils 15.

Subsequently, thanks to the induction generated by the induction coils 15, the metallic element 16 is heated until transformed into a molten state. Under the effect of surface tensions, the molten metallic element 16 substantially takes on the shape of a sphere, generally a flattened sphere, which bears against and naturally assumes a central position on the concave shape 12. The diameter of the cylindrical end portion 9 of the piston 8 is such that the molten metallic element 16 does not protrude laterally.

Subsequently, the piston 8 is moved upwards from the intermediate position thereof towards the injection chamber 4.

Figure 3:
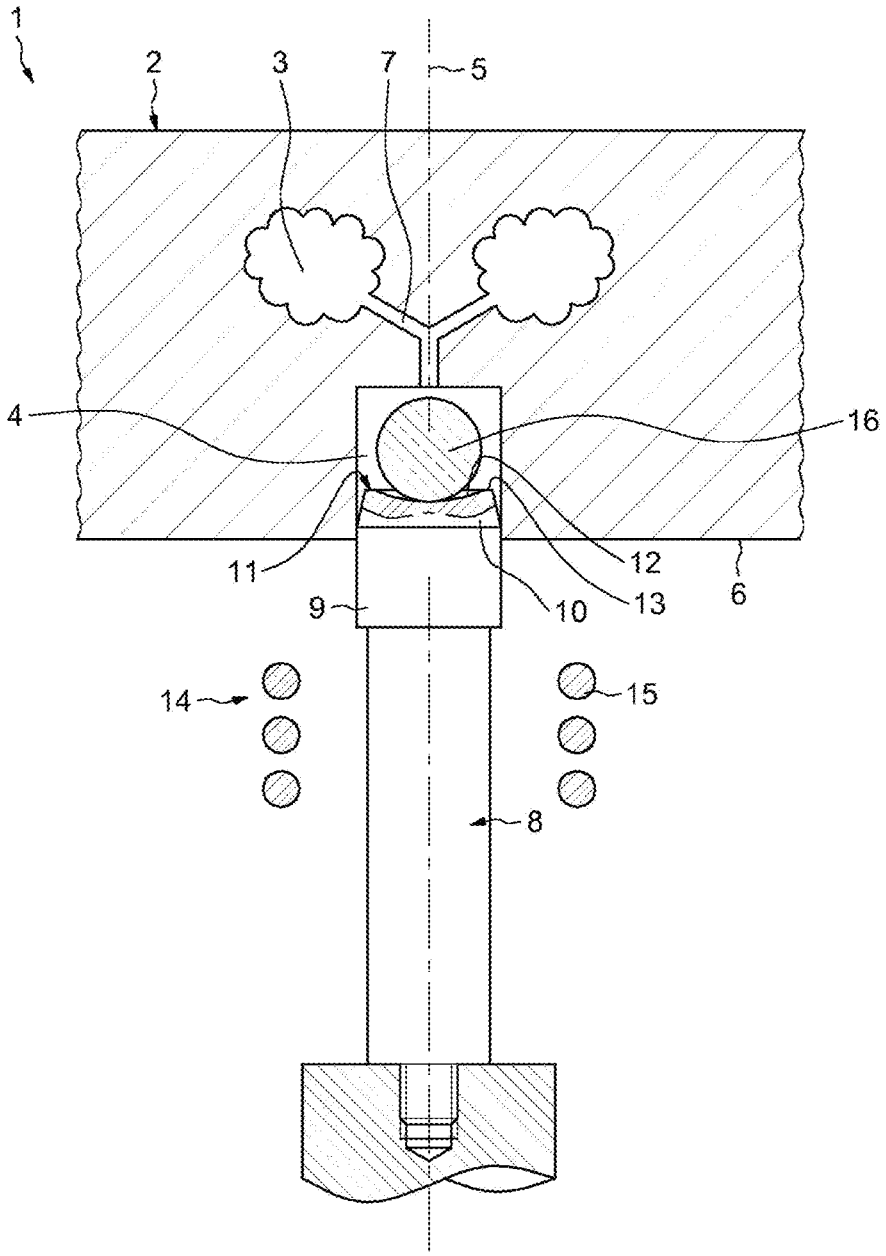
FIG. 3 shows a vertical section of the injection device in an intermediate injection position.
Figure 4:
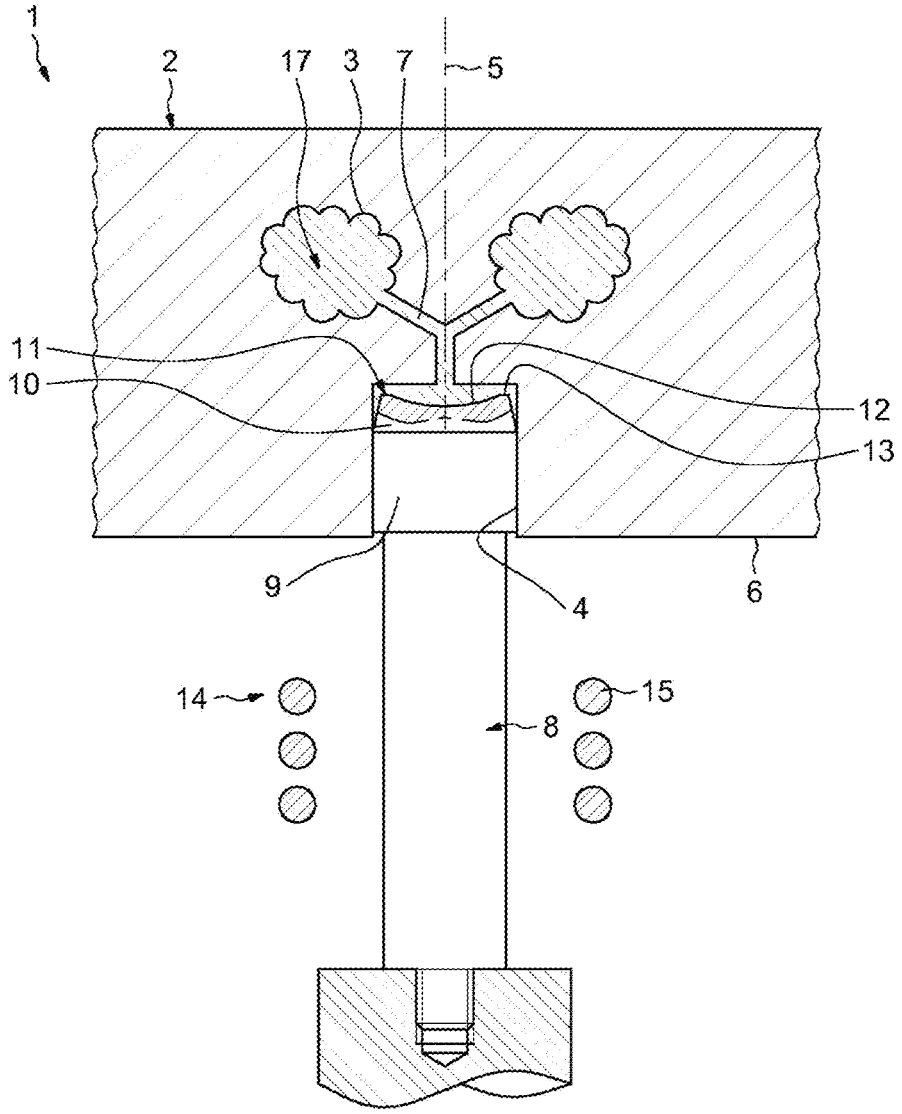
FIG. 4 shows a vertical section of the injection device in a final injection position.

In doing so, as shown in FIG. 3, the molten metallic element 16 is inserted upwardly into the injection chamber 4 without touching the peripheral wall of the injection chamber 4, then the cylindrical end portion 9 of the piston 8 engages in the injection chamber 4. After the chamfer 10 has been inserted into the injection chamber 4, the cylindrical peripheral wall of the end portion 9 of the piston 8 and the cylindrical inner wall of the injection chamber 4, forming a slide fit with little play, create a seal.

Subsequently, the upwards translational movement of the piston 8 creates a pressure in the injection chamber 4 which leads to the injection of the molten metallic glass 16 into the cavity 3 via the channel 7. As a result of the slide fit with little play between the top end portion of the piston in the injection chamber 4, metallic material is prevented from leaking. Optionally, a vent is provided in the mould 2. In the final raised injection position, the end face 11 of the piston 8 preferably does not reach the bottom of the injection chamber 4.

As a consequence thereof, until the effective injection phase in the cavity 3, the molten metallic element 16 is only locally in contact with the concave shape 12 of the piston 8, without any other contact, and remains at a distance from the cylindrical wall of the injection chamber 4 as long as it does not reach the bottom of the injection chamber 4, such that the metallic material does not crystallise.

Advantageously, the temperature of the piston 8 can be substantially less than the temperature of the heated metallic element 16, such that the metallic element 16 does not adhere to the piston 8. The mould is provided with controlled heating and/or cooling means (not shown) so that the material forming the part 17 obtained in the cavity 3 does not crystallise and that after extraction, the part 17 has the properties of a metallic glass, i.e. the properties of a metal or of a metal alloy that is amorphous or at least partially amorphous or largely amorphous.

By way of example, the heating time of the element made from metallic glass 16 can be equal to about thirty seconds and the movement time of the piston 8 from the intermediate position thereof until injection is short, for example about two seconds.

The injection device 1 is placed inside an enclosure in a controlled atmosphere that is neutral as regards the metallic glass implemented, or in a vacuum.

The piston 8 is then moved downwards into the lowered position thereof and the mould 2, which comprises joined parts, is opened in order to remove the obtained part 17 therefrom.

After possible cleaning of the mould 2, the operations described hereinabove can be repeated in order to successively produce parts made from metallic glass 17 in series.

According to one alternative embodiment shown in FIGS. 5 to 8, the piston 8 is provided with a cylindrical sleeve 18 about the top end portion 8 thereof, which are capable of sliding vertically relative to one another by a slide fit with little play. The upwards travel of the sleeve 18 relative to the piston 8 is limited by axial abutment means. For this purpose, for example, the piston 8 is provided with an outer annular radial shoulder 19 facing downwards and the sleeve 18 is provided with an inner annular radial shoulder 20 situated beneath the shoulder 19 of the piston 8 and facing upwards.

The sleeve 18 is stressed upwards relative to the piston 8 in the direction that brings the shoulders 19 and 20 closer to one another. For this purpose, for example, a helical spring 21 is mounted about the piston 8 and is axially sandwiched between an annular radial bottom face 22 of the sleeve 18 and an outer annular radial shoulder 23 of the piston 8.

In order to assemble the sleeve 18 and the spring 21, the piston comprises a bottom part **8*a* provided with the annular shoulder 23 and a top part 8*b* provided with the annular shoulder 22 and coupled with the bottom part 8*a* via a threaded axial portion 8*c***.

The sleeve 18 has an annular radial top face 24 capable of bearing against the radial bottom face 6 of the mould 2, about the injection chamber 4.

During the injection operations described hereinabove, the sleeve 18 is disposed and behaves as follows.

Figure 5:
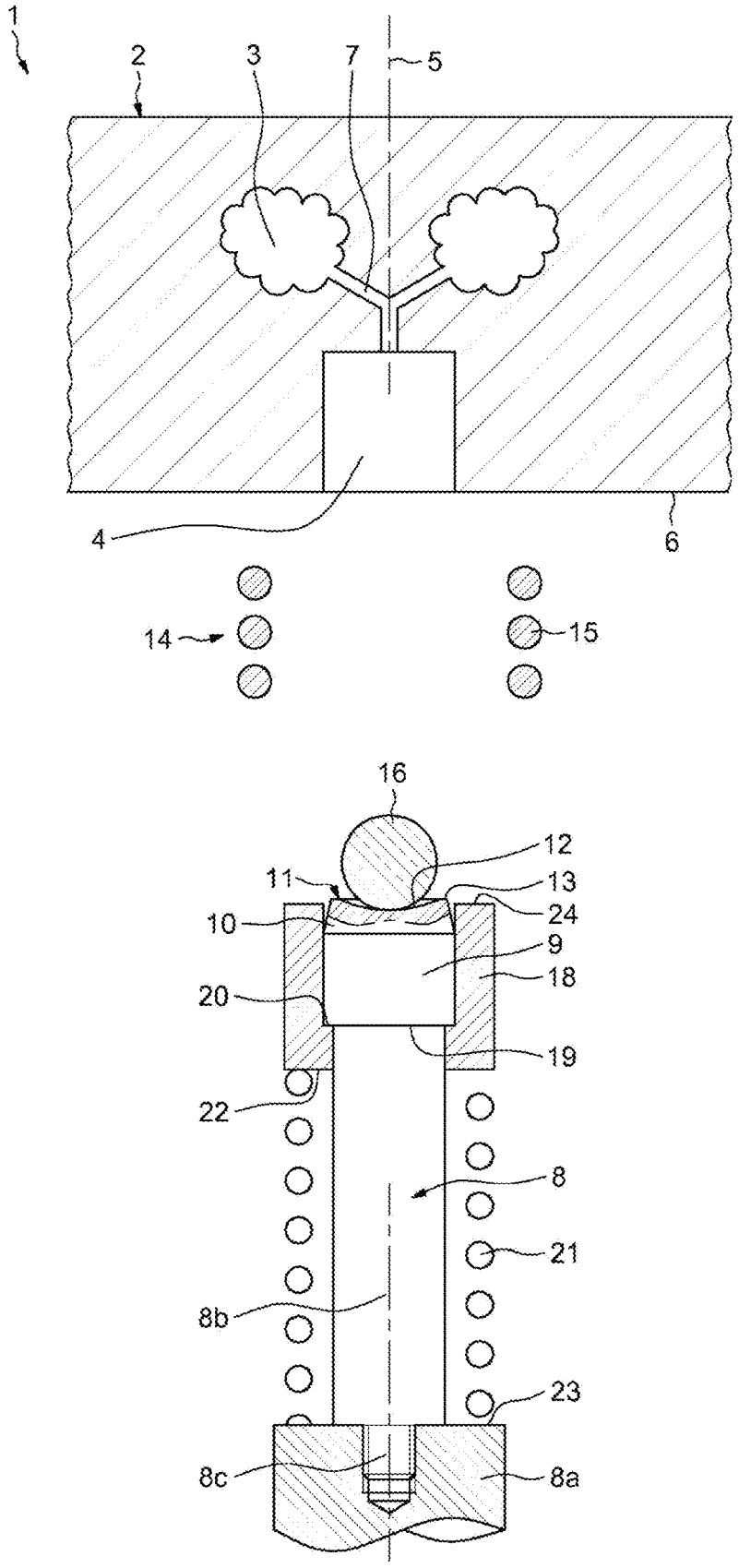
FIG. 5 shows a vertical section of one alternative embodiment of the injection device in a lowered loading position.
Figure 6:
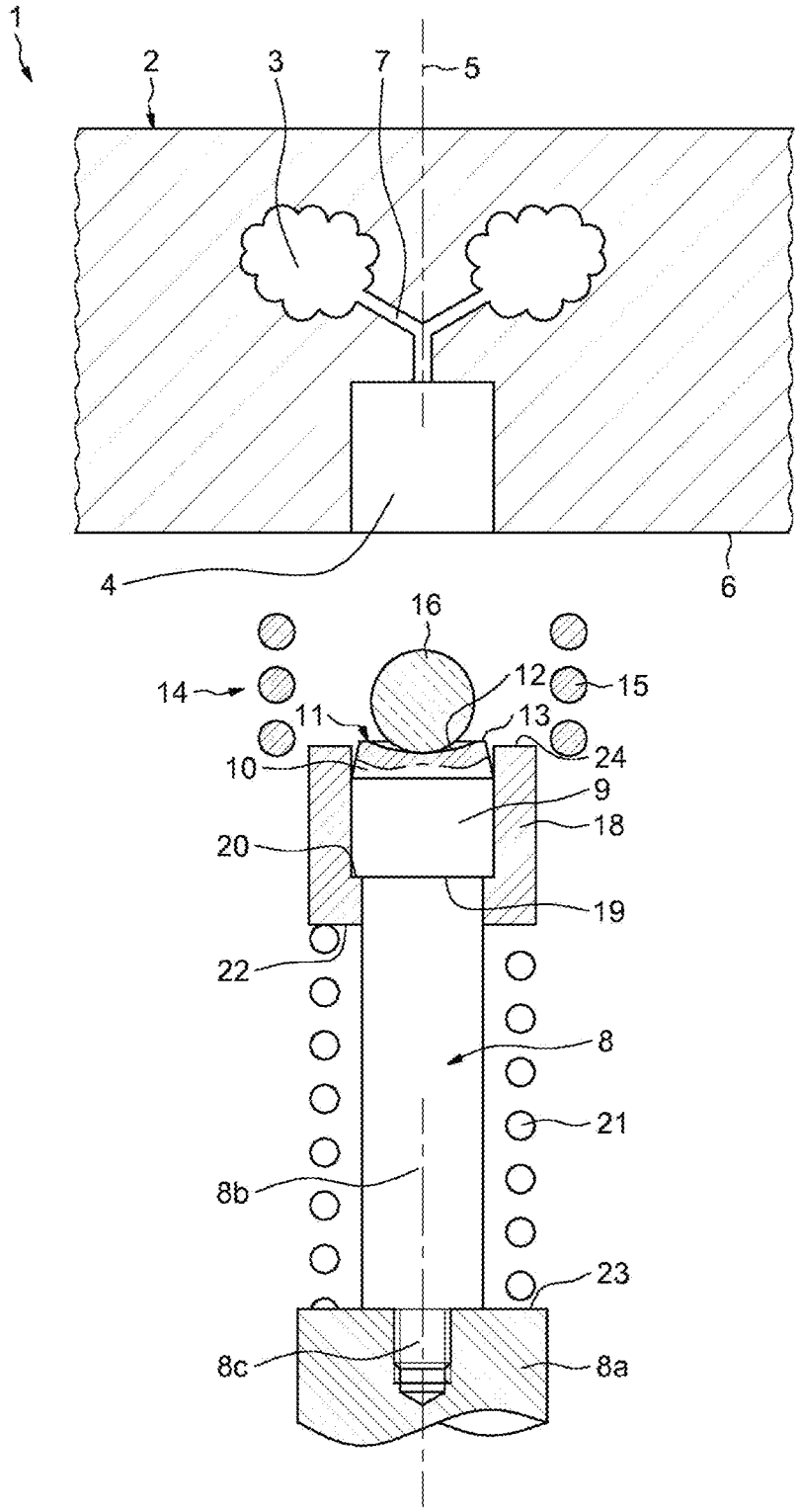
FIG. 6 shows a vertical section of the injection device in FIG. 5 in an intermediate heating position.

As shown in FIG. 5, wherein the piston 8 is in a lowered loading position corresponding to that of FIG. 1, the shoulders 19 and 20 are in contact with one another under the effect of the spring 21. The sleeve is in a raised position relative to the piston 8. The annular radial top face 24 of the sleeve 18 is situated approximately at the same level as the top end face 11 of the piston 8, optionally slightly below same. Thus, the metallic element 16 can be deposited without any lateral obstacle, on the top end face 11 of the piston 8 and does not come into contact with the sleeve 18.

The sleeve 18 retains the raised position thereof relative to the piston 8 when the piston 8 is raised towards the injection chamber 4. The metallic element 16 does not come into contact with the sleeve 18 when it is being melted when the piston 8 is in the intermediate position shown in FIG. 6, corresponding to FIG. 2, or subsequently. Moreover, the existence of the sleeve 18, the top face 24 whereof is vertically situated at or in the vicinity of the end 11 of the piston 8, does not hinder the melting operation of the metallic element 16 under the effect of the induction coils 15.

Figure 7:
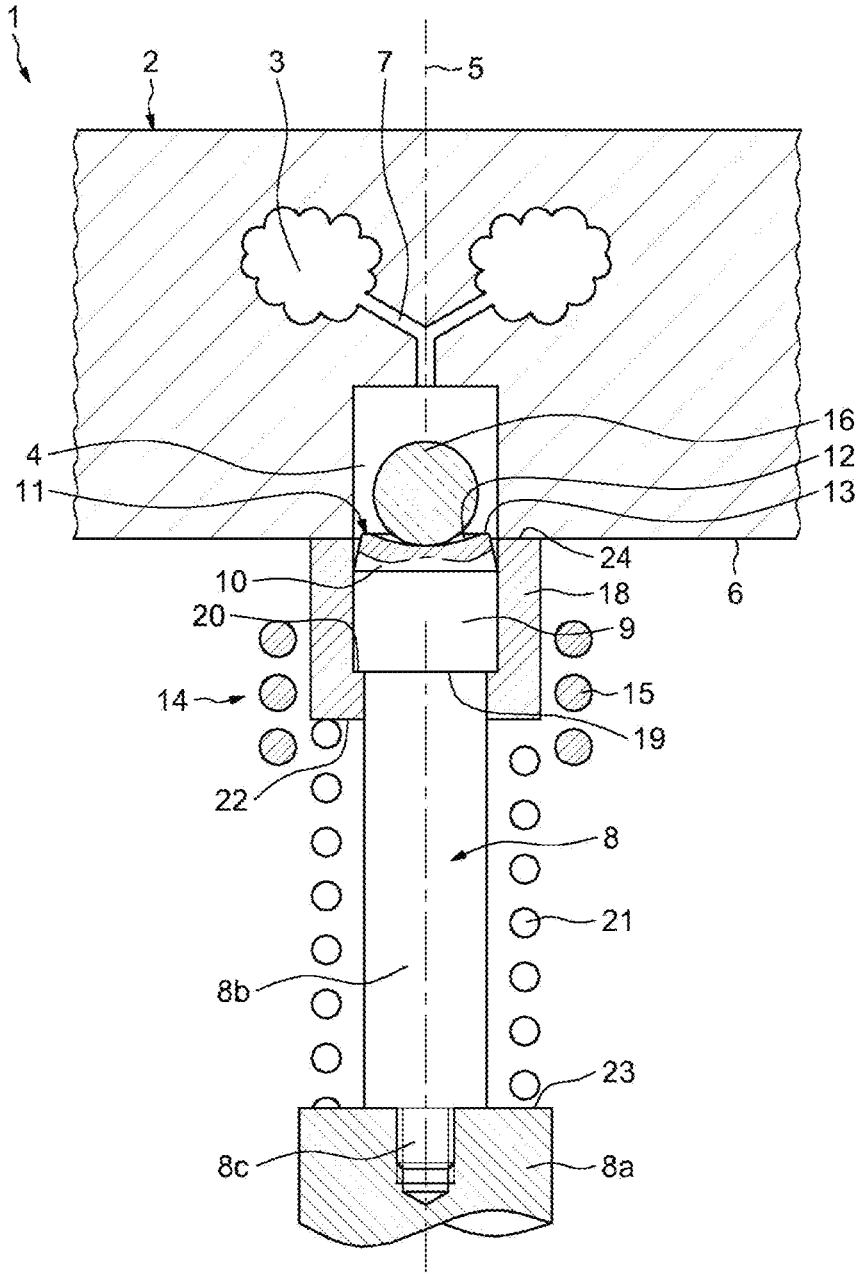
FIG. 7 shows a vertical section of the injection device in FIG. 5 in an intermediate injection position.

When the piston 8 moves in translation closer to the injection chamber 4, the molten metallic element 16 is inserted into the injection chamber 4 as described hereinabove. In this instance, the annular radial top face 24 of the sleeve 18 abuts against the radial bottom face 24 of the mould 2 as shown in FIG. 7.

Figure 8:
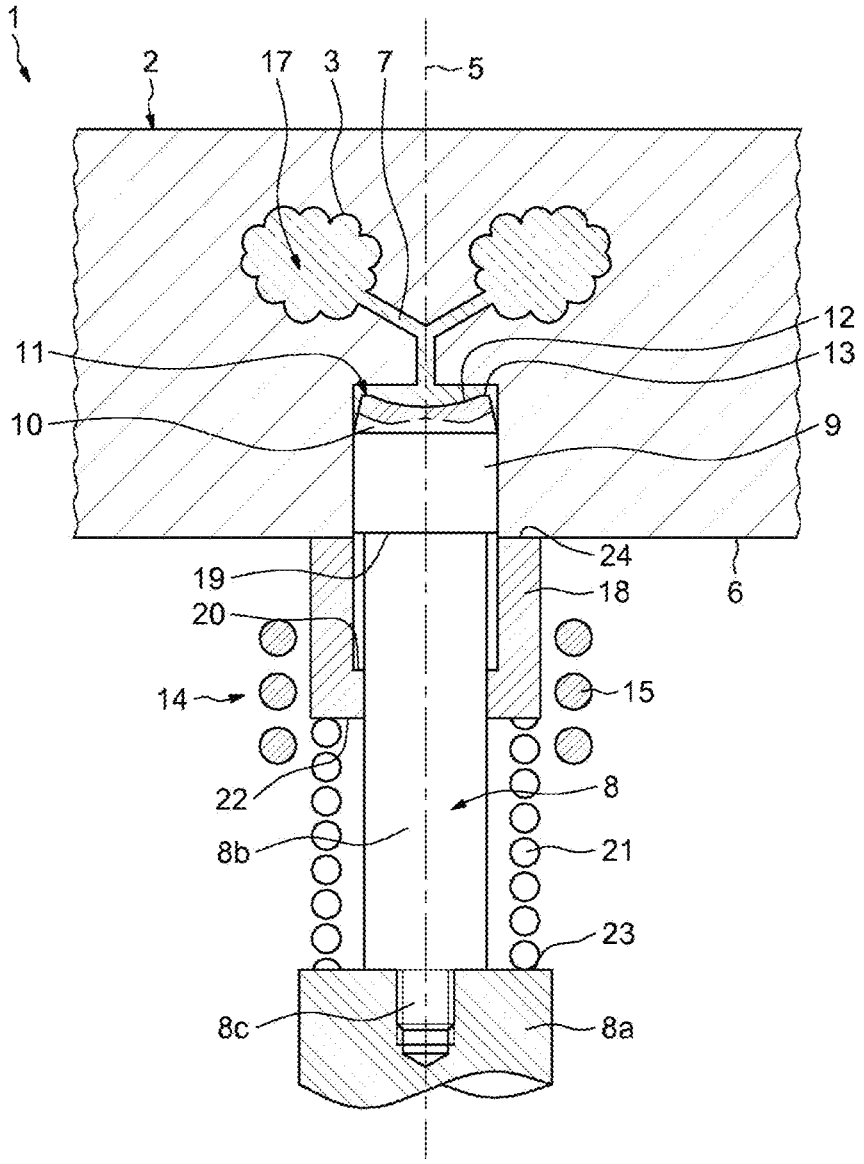
FIG. 8 shows a vertical section of the injection device in FIG. 5 in a final injection position.

The piston 8 then continues the upwards translational movement thereof in the injection chamber 4 in order to inject the metallic glass into the cavity 3 of the mould 2 as described hereinabove. In doing so, as shown in FIG. 8, the sleeve 18 bears against the radial bottom face 24 of the mould 2, the piston 8 sliding upwards relative to the sleeve 18 while compressing the spring 21 and with the shoulders 19 and 20 moving away from one another.

After injection, when the piston 8 is moved downwards in translation, the sleeve 18 retakes the raised position thereof relative to the piston 8.

Thanks to the slide fit with little play between the sleeve 18 and the top end portion 9 of the piston 8 and thanks to the contact between the annular radial top face 24 of the sleeve 18 and the radial bottom face 6 of the mould 2, about the inlet of the injection chamber 4, a seal is created when the piston 8 produces an injection pressure in the injection chamber 4 as described hereinabove.

Figure 9:
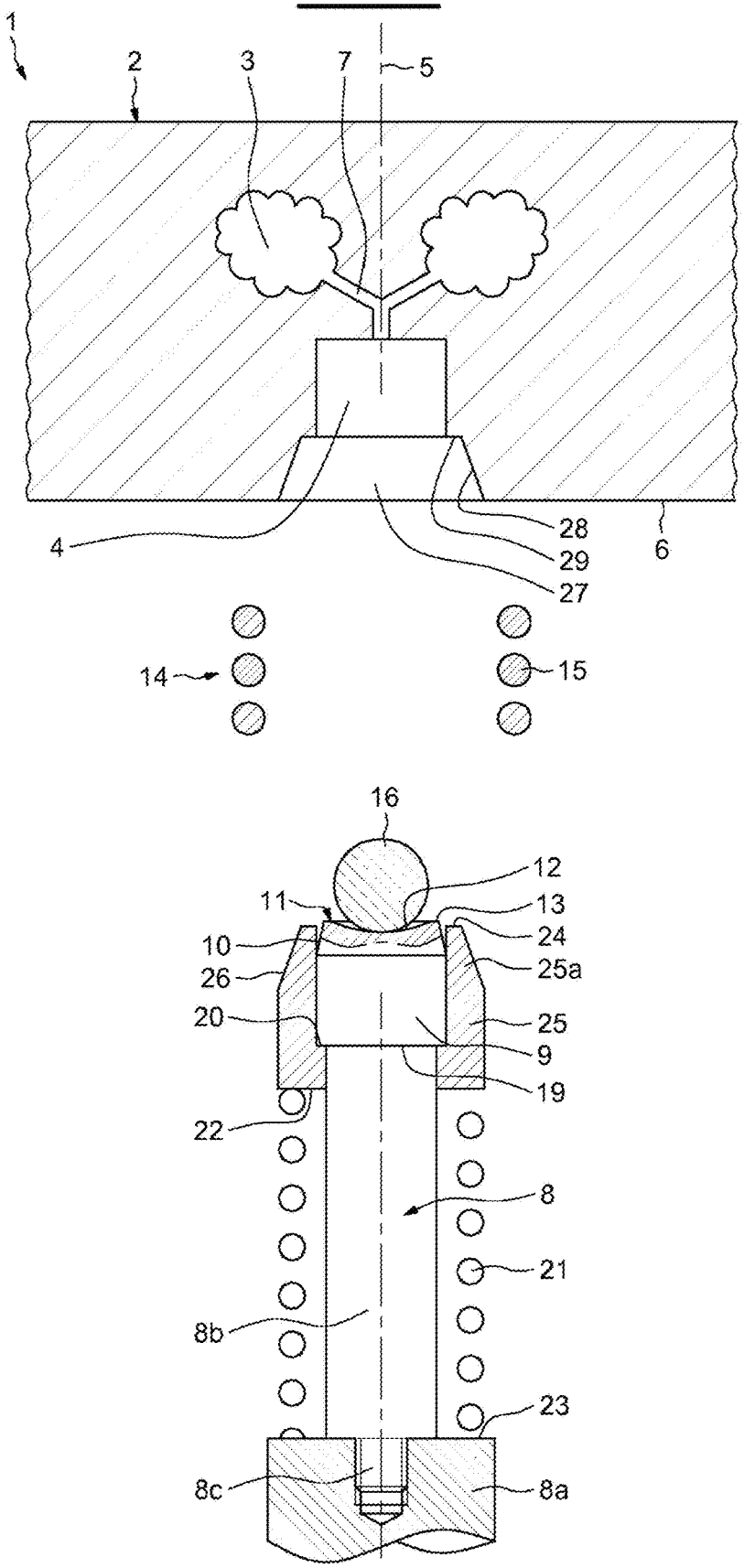
FIG. 9 shows a vertical section of another alternative embodiment of the injection device in a lowered loading position.
Figure 10:
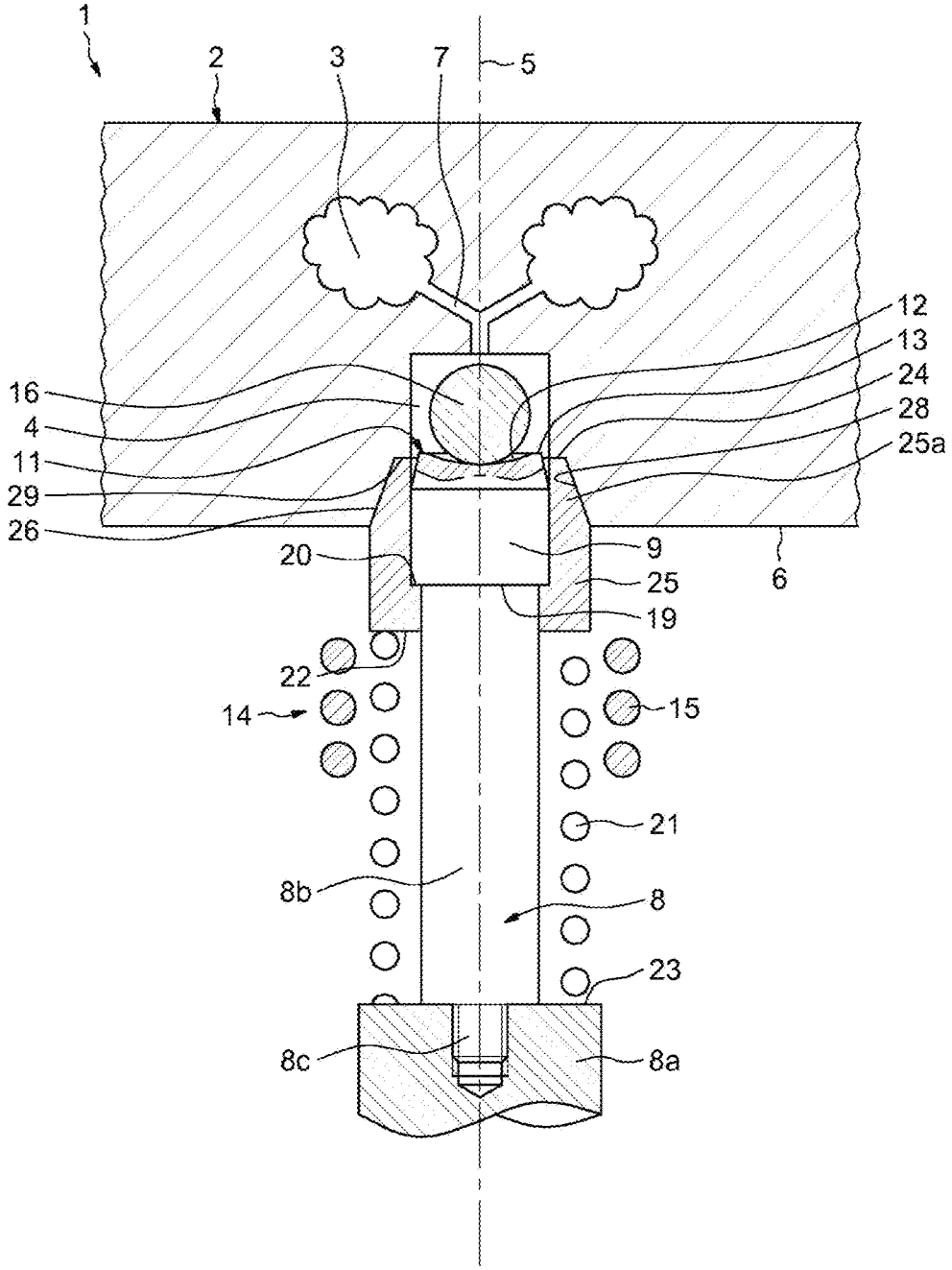
FIG. 10 shows a vertical section of the injection device in FIG. 9 in an intermediate injection position.

According to one alternative embodiment shown in FIGS. 9 and 10, the sleeve 18 is replaced by a sleeve 25 that is different from the sleeve 18 in that the top part 25*a* thereof has a frustoconical annular peripheral surface 26 that converges towards the top.

The mould 2 has an intake antechamber 27 which is situated beneath the injection chamber 4 and the peripheral wall whereof has a frustoconical annular inside surface 28 situated at the periphery of the injection chamber 4 and converging towards same.

When the piston 8 is moved upwards from the aforementioned intermediate position thereof, the top part 25*a* of the sleeve 25 penetrates the antechamber 27 until the frustoconical annular peripheral surface 26 of the sleeve 25 abuts against the frustoconical peripheral wall 28 of the antechamber 27. The frustoconical annular peripheral surface 26 of the sleeve 25 and the frustoconical peripheral wall 28 of the antechamber 27 are complementary, whereby the apex angle of these frustoconical shapes can lie in the range ten to sixty degrees. In this abutment position, the radial top end face 24 of the sleeve 25 is located at a short distance from an annular radial shoulder 29 of the mould 2, situated at the bottom of the antechamber 27 and around the injection chamber 4.

The sleeve 25 then slides relative to the piston 8, which penetrates the injection chamber 4 in order to inject the element made from metallic glass 18 placed on the piston 8 as described hereinabove.

In a manner equivalent to the contact between the annular radial top face 24 of the sleeve 18 and the radial bottom face 6 of the mould 2, about the inlet of the injection chamber 4, the contact between the frustoconical annular peripheral surface 26 of the sleeve 25 and the frustoconical peripheral wall 28 of the antechamber 27 creates, as shown in FIG. 10, a seal when the piston 8 produces an injection pressure inside the injection chamber 4 as described hereinabove.

Figure 11:
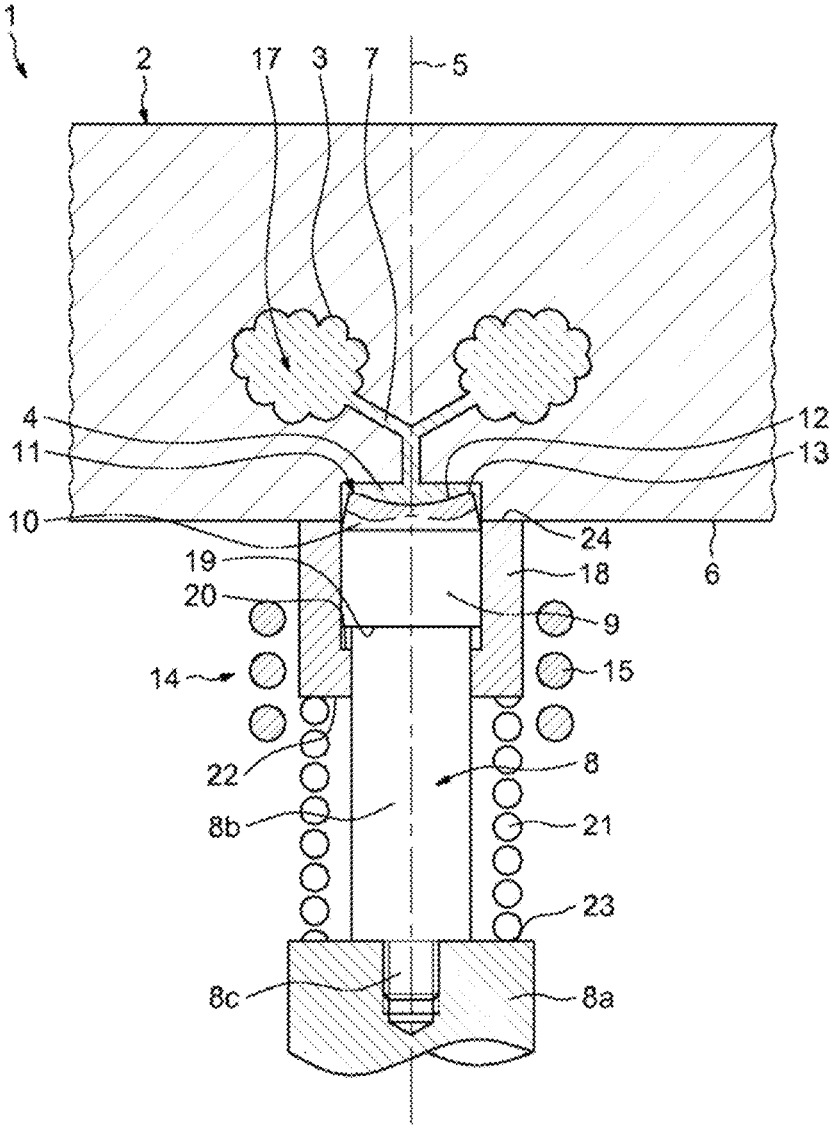
FIG. 11 shows a vertical section of an alternative embodiment of the injection device in FIG. 5 in another final injection position.

FIG. 11 shows one alternative embodiment and disposition of that described hereinabove with reference to FIG. 8.

According to this alternative embodiment, when the piston 8 reaches the final raised injection position thereof specified with reference to FIG. 8, the cylindrical peripheral wall of the cylindrical top end portion 9 does not penetrate the injection chamber 4. Only one end part of the terminal part provided with the chamfer 10 of the cylindrical top end portion 9 of the piston 8 is engaged in the injection chamber 4. The inside edge of the interface between the bearing faces 6 and 24 is situated radially facing the top end chamfer 10 of the piston 8.

In such a case, the sealing of the injection chamber 4 subjected to the injection pressure of the molten material is ensured by the annular bearing of the face 24 of the sleeve 18 against the face 6 of the mould 2 under the effect of the spring 21 and by the slide fit with little play between the piston 8 and the sleeve 18.

Figure 12:
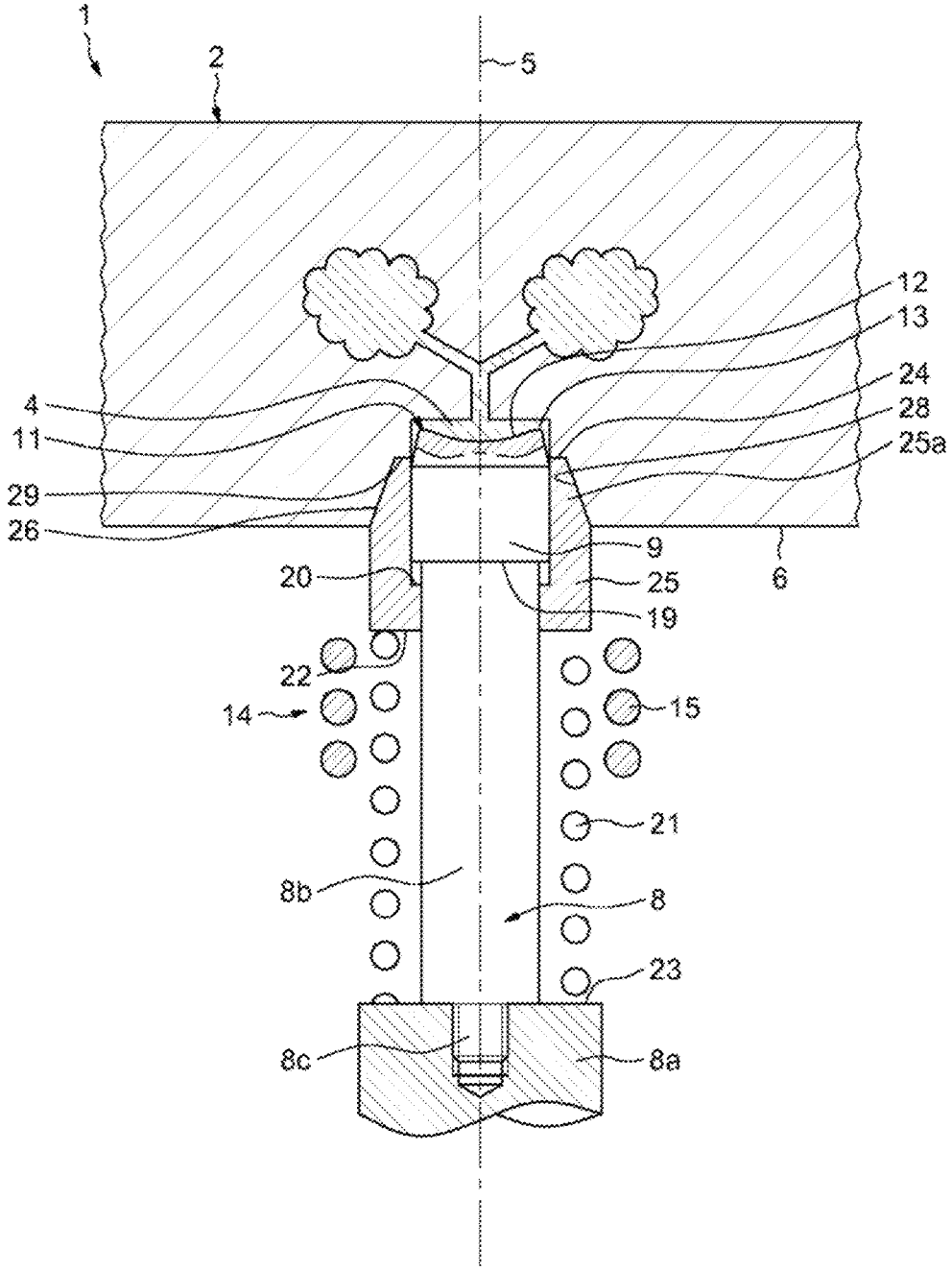
FIG. 12 shows a vertical section of an alternative embodiment of the injection device in FIG. 9 in another final injection position.

As shown in FIG. 12, one alternative embodiment and disposition equivalent to that described hereinabove with reference to FIG. 11 can be applied to the final disposition according to the alternative embodiment described with reference to FIGS. 9 and 10 wherein the sleeve 25 supported by the piston 8 has a frustoconical top part 29 engaged in a frustoconical antechamber 28 of the mould 2. In such a case, in the final injection position, the peripheral end chamfer 10 of the piston 8 is situated facing and remote from the annular inside edge of the interface between the radial annular bottom 29 of the mould 2 of the antechamber 27 and the annular radial end face 24 of the piston 8.

Advantageously, the device 1 can be provided with a heating element at least one top part of said vertical piston 8, such that the material forming the metallic element 16 does not cool or cools very little on contact with the concave shape 12, in particular during the aforementioned injection phase, so that the metallic material retains the molten state thereof and so that the metallic material remaining in the chamber 4 retains the molten state thereof as long as the cavity 3 has not been correctly and completely filled with the molten metallic material.

For example, this heating means can be formed by a heating element the portion 8*a* of the piston 8, the heat wherefrom is transmitted by conduction to the top portion 9 on which the metallic element 16 is placed. This heating means can comprise resistance or induction coils placed around the portion 8*a* of the piston 8 or can be formed by a heating fluid flowing in channels made in the piston 8.

The invention claimed is:

1. An injection device for producing at least one metallic glass part, comprising:

a mold having at least one cavity and an injection chamber in connection with the at least one cavity, wherein the injection chamber has a lower injection opening extending through a lower surface of the mold and a sidewall surface extending upwardly from the injection opening;

a vertical injection piston coaxial with the injection chamber, the piston being arranged for vertical movement between a lower load position and an upper injection position;

the piston having an upper surface for retaining a charge volume of a metallic material, wherein when the piston is moved upwardly into the injection position, the metallic material is forced into an upper region of the injection chamber, thereby causing a first portion of the metallic material to be injected into the least one cavity;

wherein the upper surface of the piston comprises a recess for receiving and retaining a minor portion of the charge volume of the metallic material whereby a major portion of the charge volume of the metallic material extends above an uppermost portion of the upper surface of the piston; and a heating element situated under the mold and coaxial with the piston, whereby, when the piston moves upwardly from an initial load position to an injection position, the charge volume of the metallic material will pass through and be directly exposed to the heating element before entering the injection chamber.

2. The device according to claim 1, wherein the top surface of the piston further comprises a peripheral chamfered surface.

3. The device according to claim 2, wherein a lower portion of the injection chamber defines a frustoconical surface.

4. The device according to claim 1, wherein the recess defines a spherical cap, conical, arcuate, or frustoconical surface.

5. The device according to claim 1, wherein the injection chamber comprises a lower entry portion having a first width and an upper chamber having a second width, wherein the first width is larger than the second width.

6. The device according to claim 1, wherein an upper portion of the piston comprises an outer surface configured to establish a slide fit with the sidewall surface of the injection chamber.

7. The device according to claim 1, further comprising:

a sleeve disposed around an upper portion of the piston and capable of sliding vertically relative to the piston, the piston and the sleeve having an axial abutment element that limits an upwards movement of the sleeve relative to the piston and a spring biasing the sleeve upwardly relative to the piston, wherein the sleeve comprises an annular bearing face configured for contacting an annular bearing face of the mold situated at a periphery of the injection opening.

8. The device according to claim 7 wherein the sleeve is able to slide vertically relative to the upper portion of the piston by forming a slide fit.

9. The device according to claim 7, wherein the sleeve has an annular top surface situated approximately at the top end face of the piston when the abutment element are in abutment.

10. The device according to claim 7, wherein the annular bearing face of the sleeve and the annular bearing face of the mold extend radially.

11. The device according to claim 7, wherein the annular bearing face of the sleeve and the annular bearing face of the mold are frustoconical.

12. The device according to claim 7, wherein a top portion of the sleeve is capable of entering an antechamber provided in of mold beneath and axially aligned with the injection chamber.

13. The device according to claim 1, wherein the heating element is capable of putting the metallic material in fusion before the metal material enters the injection chamber.

14. The device according to claim 1, further comprising a heating element provided at the upper of the vertical piston.

15. An injection method for producing at least one metallic glass part, comprising the steps of:

preparing an injection mold comprising an injection chamber with an injection opening through a lower surface of the mold and at least one cavity corresponding to the part in communication with the injection chamber;

placing a charge volume of a solid metallic element capable of forming a metallic glass on a top surface of a vertical injection piston, the top surface comprising a recess configured for receiving a minor portion of the charge volume with a major portion of the charge volume extending above the uppermost portion of the top surface;

heating the charge volume of said metallic element by passing the charge volume through an induction heater, the induction heater comprising an induction coil arranged to be directly coaxial to the piston, such that, when the piston is in an intermediate position, the majority of the metallic element is in an open space and surrounded solely by the induction coils;

continuing the heating step until the metallic element is in fusion and assumes a shape of an oblate spheroid retained by the recess;

displacing the piston upwards to transfer the metallic element in fusion into the injection chamber to reach an injection pressure inside the injection chamber of the mold and inject a volume of the molten metallic material into the at least one cavity of the mold linked to the injection chamber; and cooling the first volume of the metallic material to obtain an amorphous solid within the at least one cavity.

16. The method according to claim 15, wherein, in order to inject the metallic material in fusion, a top portion of the piston is inserted into the injection chamber, the top portion of the piston and the injection chamber jointly forming a slide fit.

17. The method according to claim 15, wherein a sleeve is mounted on the top end portion of the piston, wherein the sleeve and the top portion of the piston form therebetween a slide fit for sliding and wherein the sleeve and the mold have annular bearing faces bearing against one another when the metallic material is injected.

18. The method according to claim 17, wherein, in a final injection position, a peripheral end chamber of the piston is facing and remote from the inside edge of the interface between the annular bearing faces bearing against one another.

19. The method according to claim 15, further comprising a step of heating the top portion of the vertical piston.

20. An injection device for producing at least one metallic glass part, comprising:

a mold having at least one cavity and an injection chamber in connection with the at least one cavity, wherein the injection chamber has a lower injection opening extending through a lower surface of the mold and a sidewall surface extending upwardly from the injection opening;

a vertical injection piston coaxial with the injection chamber, the piston being arranged for vertical movement between a lower load position and an upper injection position;

the piston having an upper surface for retaining a charge volume of a metallic material wherein when the piston is moved upwardly into the injection position, the metallic material is forced into an upper region of the injection chamber, thereby causing a first portion of the metallic material to be injected into the least one cavity;

wherein the upper surface of the piston comprises a recess for receiving and retaining a minor portion of the charge volume of the metallic material whereby a major portion of the charge volume of the metallic material extends above an uppermost portion of the upper surface of the piston; and a heating element situated under the mold and coaxial with the piston, whereby, when the piston moves upwardly from an initial load position to an injection position, the charge volume of the metallic material will pass through the heating element without the major portion of the metallic material being separated from the heating element by any wall, before entering the injection chamber.

* * * * *